US006664036B1

(12) United States Patent
Lowe et al.

(10) Patent No.: US 6,664,036 B1
(45) Date of Patent: Dec. 16, 2003

(54) HOMOGENEOUS SINGLE-PART COLOR DEVELOPER PER COLOR FILM PROCESSING AND METHOD OF USING SAME

(75) Inventors: Thomas E. Lowe, Mendon, NY (US); Terrence R. O'Toole, Webster, NY (US); Charles M. Darmon, Spencerport, NY (US); Michael P. Youngblood, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/229,666

(22) Filed: Aug. 28, 2002

(51) Int. Cl.[7] ..... G03C 7/413
(52) U.S. Cl. ..... 430/466; 430/493
(58) Field of Search ..... 430/466, 493

(56) References Cited

U.S. PATENT DOCUMENTS

| | | | | | |
|---|---|---|---|---|---|
| 4,232,113 | A | | 11/1980 | Marchesano | 430/450 |
| 4,987,060 | A | | 1/1991 | Marchesano | 430/434 |
| 5,273,865 | A | | 12/1993 | Loiacono et al. | 430/490 |
| 5,376,510 | A | | 12/1994 | Parker et al. | 430/466 |
| 5,489,505 | A | * | 2/1996 | Kato et al. | 430/584 |
| 5,660,974 | A | | 8/1997 | Marrese et al. | 430/490 |
| 5,837,435 | A | | 11/1998 | Abe | 430/490 |
| 5,869,223 | A | | 2/1999 | Roussilhe | 430/399 |
| 5,891,609 | A | | 4/1999 | Papai | 430/466 |
| 5,914,221 | A | | 6/1999 | Kim et al. | 430/466 |
| 6,077,651 | A | | 6/2000 | Darmon et al. | 430/466 |
| 6,197,484 | B1 | | 3/2001 | Kim et al. | 430/450 |
| 6,416,940 | B2 | | 7/2002 | Haye et al. | 430/466 |

FOREIGN PATENT DOCUMENTS

| | | |
|---|---|---|
| EP | 0 204 372 | 12/1986 |
| EP | 0 528 406 A1 | 2/1993 |
| EP | 0 793 141 A3 | 9/1997 |
| EP | 0 800 111 A1 | 10/1997 |
| WO | WO 99/46641 | 9/1999 |

* cited by examiner

*Primary Examiner*—Hoa Van Le
(74) *Attorney, Agent, or Firm*—J. Lanny Tucker

(57) ABSTRACT

An aqueous, homogeneous, single-part color developing concentrate comprises a color developing agent in free base form and an N,N-dialkyl- or N,N-diarylhydroxylamine antioxidant that has at least one solubilizing substituent. The concentrate also includes a water-miscible or water-soluble organic co-solvent that has a molecular weight of from about 100 to about 400, is present in the concentrate at a concentration such that the weight ratio of water to the organic co-solvent is from about 7:1 to about 30:1, and is represented by the following Structure I:

$$Y—Z^{-}M^{+} \qquad (I)$$

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, or a carbocyclic aryl group having 6 or 10 carbon atoms in the ring, $Z^{-}$ is a monovalent group comprising a single negative charge or an acidic group that is ionized to a single negative charged group at pH of 10 or more, and $M^{+}$ is a monovalent cation. The concentrate can be used to make a working strength processing solution, or it can be used as a replenishing composition with proper dilution, and is particularly useful for processing color negative or color reversal photographic silver halide films.

18 Claims, No Drawings

HOMOGENEOUS SINGLE-PART COLOR DEVELOPER PER COLOR FILM PROCESSING AND METHOD OF USING SAME

FIELD OF THE INVENTION

The present invention relates to single-part, homogeneous photographic color developing concentrate useful for providing color images in color photographic films and to a method for providing such color images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa et al.), U.S. Pat. No. 5,354,646 (Kobayashi et al.) and U.S. Pat. No. 5,660,974 (Marrese et al.).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

Problem to be Solved

There is a desire in the industry to reduce the number of parts used to prepare color developing compositions, and particularly to prepare replenishing solutions. A wide range of compositions are described in the art or commercially available as "ready to use" solutions, concentrates or dry formulations. Liquid concentrates have only to be diluted with water to provide a working strength solution. Dry formulations need only be dissolved in water. For example, EP 0 793,141A1 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions is steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

The industry has investigated the use of both concentrates and solid mixtures (including powders and tablets). In most cases, concentrates are convenient to use but may have high packaging costs compared to powders or be in the form of slurries or two-phase mixtures. Powders permit high concentration, but not every photochemical composition can be dried into a stable powder. In addition, powders present problems with dust, separate packaging needs, and more troublesome metering or mixing procedures. Not all dry processing compositions are readily dissolved in water.

For instance, the common color developing compositions used to provide color images in color negative films are typically obtained by combining three "parts" into a single solution. Currently, the conventional antioxidant, hydroxylamine sulfate, must be kept separated from sulfites until they are used in processing. Similarly, the conventional color developing agent, 4-(N-ethyl-N-β-hydroxyethylamino)-2-methylaniline sulfate (KODAK Color Developing Agent CD-4) must be kept at low pH for solubility purposes, but a low pH environment is not suitable for other essential photoprocessing chemicals.

The casual observer might consider that all of the conventional "parts" used to provide color developing compositions might be readily combined to form a single-part homogeneous composition. This is not as easy as one may think. Interactions among and deterioration of photochemicals are magnified in concentrated form, and the resulting action on processed photographic materials may be undesirable because of the resulting poor images.

Some color developing compositions are commercially available in single-part formulation that overcomes some of the noted problems, but because of the presence of precipitates (such as in slurries) or multiple solvent phases, they require vigorous agitation or mixing before use. Such compositions are generally limited to small volumes. In addition, the presence of the precipitates or "sludge" may be unattractive to users. Some users may not have suitable equipment for proper agitation of multi-phase compositions.

Additional small volume, ready to use color developing compositions are described in U.S. Pat. No. 5,273,865 (Loiacono et al). These compositions are said to be free of bromides, hydroxylamines and benzyl alcohol, to include a polyol compound having 4 to 8 hydroxy groups, and to be useful for rapid access processing of photographic elements having high silver bromide emulsions only.

A very useful single-part color developing composition that is homogeneous, concentrated, and stable is described in U.S. Pat. No. 6,077,651 (Darmon et al.). Such compositions are stable from the presence of the free base form of the color developing agent and a particular amount of water-miscible organic solvent to promote its solubility. These concentrated compositions are most useful for processing color photographic papers.

There is a continuing need in the photographic industry for a single-part color developing composition that is homogeneous, concentrated, stable, and useful for processing color negative films. Such concentrated compositions require different components and formulation than the compositions normally used to process color photographic papers. The present invention is directed to meeting this need in the art.

SUMMARY OF THE INVENTION

This invention provides an advance in the art with an aqueous, homogeneous, single-part color developing concentrate having a pH of from about 9 to about 13 and comprising:

a) at least 0.05 mol/l of an N,N-dialkyl-p-phenylenediamine color developing agent in free base form, b) at least 0.1 mol/l of an antioxidant composition for the color developing agent that comprises an N,N-dialkyl- or N,N-diarylhydroxylamine derivative having at least one solubilizing group, and c) a water-miscible or water-soluble organic co-solvent that has a molecular weight of from about 100 to about 400, is present in the concentrate at a concentration such that the weight ratio of water to the organic co-solvent is from about 7:1 to about 30:1, and is represented by the following Structure I:

$$Y—Z^{-}M^{+} \quad (I)$$

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, or a carbocyclic aryl group having 6 or 10 carbon atoms in the ring, $Z^{-}$ is a monovalent group comprising a single negative charge or an acidic group that is ionized to a single negative charged group at pH of 10 or more, and $M^{+}$ is a monovalent cation.

In preferred embodiments, the present invention provides an aqueous, homogeneous, single-part color developing concentrate having a pH of from about 10 to about 11 and comprising:

a) from about 0.05 to about 0.2 mol/l of 4-(N,N-diethyl)-2-methylaniline hydrochloride (KODAK Color Developing Agent CD-2), 4-(N-ethyl-N-methanesulfonamidoethyl)-2-methylaniline sesquisulfate (KODAK Color Developing Agent CD-3), or 4-(N-ethyl-N-β-hydroxyethyl)-2-methylaniline sulfate (KODAK Color Developing Agent CD-4) in free base form, b) from about 0.1 to about 0.4 mol/l of an antioxidant composition for the color developing agent that consists essentially of N,N-bis(ethylenesulfonato) hydroxylamine, N,N-bis(2,3-dihydroxypropyl) hydroxylamine, or N-isopropyl-N-ethylsulfonatohydroxylamine, c) a water-miscible or water-soluble benzoic acid or an alkali metal salt thereof that has a molecular weight of from about 120 to about 200, is present in the concentrate at a concentration such that the weight ratio of water to the organic co-solvent is from about 10:1 to about 15:1, e) a carbonate buffering agent, and f) from about 0.1 to about 0.5 mol/l of sulfite ions.

Still again, this invention provides a photographic processing chemical kit comprising:

I) an aqueous, homogeneous, single-part color developing concentrate of this invention, and II) one or more of the following compositions:
a photographic bleaching composition,
a photographic bleach/fixing composition,
a photographic fixing composition, or
a photographic stabilizing or final rinsing composition.

Further, this invention provides a method for providing a color photographic image comprising contacting a color negative or reversal photographic silver halide film with, upon dilution at least 2.5 times, the aqueous, homogeneous, single-part color developing concentrate of this invention.

Preferred methods of this invention for photographic processing comprise the steps of:

A) color developing an imagewise exposed color negative or color reversal photographic silver halide film with, upon dilution at least four times, the aqueous, homogeneous, single-part color developing concentrate of this invention, and B) desilvering the color developed color negative or reversal photographic silver halide film.

The single-part color developing concentrate and use of this invention offer a number of advantages over the photochemical compositions currently available or known. Our concentrate has minimal water, resulting in considerable savings in manufacturing, shipping and storage costs. In addition, it is a homogeneous composition, meaning that it is free of precipitates, slurries or multiple solvent phases. It does not require vigorous agitation prior to use, and can be immediately and readily metered into a photographic processing tank or bath with minimal instruction or possibility of mistake. For example, the concentrate can be used in "automatic replenishing" processors where the processing composition is diluted and used as needed. Importantly, it provides a single-part composition so the mixing of multiple parts, whether liquid or solid, is avoided.

The concentrate of this invention and the resulting working strength color developing composition have less odor than many conventional multi-part color developing compositions. Moreover, it was unexpected to us that formulating the chemicals needed for color development into a single-part composition resulted in minimal loss in chemical stability of any of those chemicals (such as the antioxidant and color developing agent) and minimal change in pH.

The color developing agent is provided in "free base" form meaning that the usual anions (such as sulfate ions) are removed early in the formulation of the composition by precipitating them in the presence of an alkali metal base. Preferably, the resulting color developing concentrate is essentially sulfate ion free (meaning less than 0.005 mol/l of sulfate ion).

Concentrate stability is provided by the presence of a particular organic co-solvent that has a critical molecular weight of from about 100 to about 400. This organic co-solvent is present at a concentration such that the weight ratio of water to the organic co-solvent is from about 10:1 to about 15:1, and is either a benzene having one, and only one, carboxy, hydroxy (provided the hydroxy group is substantially ionized in the range pH 10 to 11), or sulfo substituent or an aliphatic compound having a 4 to 16 carbon alkyl chain that has one, and only one, carboxy, or sulfo substituent.

DETAILED DESCRIPTION OF THE INVENTION

The homogeneous, single-part color developing concentrate of this invention is prepared by making an aqueous solution of a suitable color developing agent. Initially, the color developing agent is generally in the form of a sulfate salt. This solution also includes the noted organic co-solvent containing a carboxy or sulfo group.

In this environment, especially at high alkalinity, alkali metal ions and sulfate ions form a sulfate salt that is precipitated in the presence of the organic co-solvent. The precipitated sulfate salt can then be readily removed using any suitable liquid/solid phase separation technique (including filtration, centrifugation or decantation).

The color developing concentrates of this invention include one or more color developing agents that are well known in the art that, in oxidized form, will react with dye forming color couplers in the processed materials. Such color developing agents are p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011). This reference will be referred to hereinafter as *"Research Disclosure"*.

Preferred color developing agents include, but are not limited to, 4-(N,N-diethyl)-2-methylaniline hydrochloride (KODAK Color Developing Agent CD-2), 4-(N-ethyl-N-methanesulfonamidoethyl)-2-methylaniline sesquisulfate (KODAK Color Developing Agent CD-3), or 4-(N-ethyl-N-β-hydroxyethyl)-2-methylaniline sulfate (KODAK Color Developing Agent CD-4), and others readily apparent to one skilled in the art. KODAK Color Developing Agents CD-2 and CD-4 are particularly useful in the practice of this invention.

In order to protect the color developing agents from oxidation, one or more antioxidants are included in the color developing concentrates of this invention in an antioxidant composition. Inorganic antioxidants can be used in these composition or mixtures of inorganic and organic antioxidants can be present. Many classes of useful inorganic antioxidants are known, including but not limited to, sulfites (such as sodium sulfite, potassium sulfite, sodium bisulfite, and potassium metabisulfite). Mixtures of sulfites can be used if desired. When present, the sulfite ions are used at a minimum concentration of 0.1 mol/l.

In preferred antioxidant compositions, it is essential that certain hydroxylamine derivatives be utilized. These hydroxylamine derivatives are N,N-dialkyl- and N,N-diarylhydroxylamines in which at least one of the alkyl or aryl groups is substituted with one or more solubilizing groups such as sulfo, carboxy, hydroxy, or phospho groups. Preferably, the substituents are hydroxy or sulfo groups and more preferably, each alkyl group has the same type and number of substituents.

Useful hydroxylamine derivatives of this types are described for example, in U.S. Pat. Nos. 4,892,804, 4,876,174, 5,354,646 (all noted above), U.S. Pat. No. 5,709,982 (Marrese et al.), and U.S. Pat. No. 5,646,327 (Burns et al.), the disclosures of which are all incorporated herein by reference.

Particularly useful N,N-dialkylhydroxylamines comprise alkyl groups that have 1 to 4 carbon atoms, and preferably 2 or 3 carbon atoms, at least one of which is substituted with a solubilizing group noted above. The alkyl groups can be the same or different and preferably, they are the same. Thus, the most preferred compounds are N,N-diethyl- or N,N-dipropyl (n- or iso-)hydroxylamines wherein one or both of the ethyl or propyl groups have one or more carboxy, hydroxy, or sulfo substituents. Particularly useful N,N-dialkylhydroxylamines include N,N-bis(ethylenesulfonato) hydroxyamine, N,N-bis(2,3-dihydroxypropyl) hydroxylamine, and N-isopropyl-N-ethylenesulfonatohydroxylamine.

The alkyl groups in the hydroxylamine derivative can be joined together to form a heterocyclic compound.

A most preferred antioxidant composition consists essentially of one or more N,N-dialkylhydroxylamine derivatives as defined above.

The noted antioxidants (organic or inorganic) are either commercially available or prepared using starting materials and procedures described in the references noted above in describing hydroxylamines.

Buffering agents are generally present in the color developing concentrates of this invention to provide or maintain desired alkaline pH of from about 7 to about 13, preferably from about 8 to about 12, and more preferably from about 10 to about 11. These buffering agents are generally soluble in the organic co-solvent described herein and have a pKa of from about 9 to about 13. Such useful buffering agents include, but are not limited to, carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An essential component of the color developing concentrates of this invention is a photographically inactive, water-miscible or water-soluble, organic co-solvent that is capable of dissolving color developing agents in their free base forms. Such organic co-solvents can be used singly or in combination, and preferably each has a molecular weight of at least 100, and preferably of at least 120, and generally 400 or less and preferably 220 or less.

The useful organic co-solvents can be represented by the following Structure I:

$$Y—Z^-M^+ \quad (I)$$

wherein Y must be uncharged in the pH range of from 10 to 11, and is a substituted or unsubstituted alkyl group having 4 to 16 carbon atoms (such as n-butyl, iso-butyl, t-butyl, n-hexyl, n-heptyl, benzyl and other linear and branched alkyl chains readily apparent to one skilled in the art), a substituted or unsubstituted cycloalkyl group having 5 to 10 carbon atoms in the ring (such as cyclopentyl, 4-methylcyclohexyl, cycloheptyl, and others readily apparent to one skilled in the art), an alkylene group having 1 to 6 carbon atoms that is additionally substituted with a cycloalkyl group, a carbocyclic aryl group, or a heterocyclic group containing 1 to 3 hetero atoms (nitrogen, oxygen, or sulfur), or a substituted or unsubstituted carbocyclic aryl group having 6 or 10 carbon atoms in the ring (such as benzyl, naphthyl, tolyl, 2-aminobenzyl, and 2-nitrobenzyl).

$Z^-$ is a monovalent group comprising a single negative charge or an acidic group that is ionized to a single negative charged group at pH of 10 to 11. Useful $Z^-$ groups include carboxy, sulfo, and hydroxy groups, provided that the said hydroxy groups are substantially ionized in the pH range of from 10 to 11. The acidic group can be directly bonded to "Y", or it can be linked to "Y" through a suitable linear or branched, substituted or unsubstituted alkylene group (such as those having 1 to 6 carbon atoms in the chain), a substituted or unsubstituted cycloalkylene group (such as 1,4-cyclohexylene), or a substituted or unsubstituted arylene group (such as 1,4-phenylene). Preferably $Z^-$ is bonded directly to "Y".

$M^+$ is a suitable monovalent cation such as hydrogen, an alkali metal ion, or an ammonium ion.

Preferably The organic co-solvent used in the concentrate of this invention is either a benzene ring having at least one carboxy or sulfo substituent or an aliphatic compound comprising a 4- to 8-carbon atom alkyl chain that has at least one carboxy or sulfo substituent.

By "benzene" compound we mean a 6-membered carbocyclic compound that has no fused rings but has one and only one singly negatively charged substituent or an acidic substituent that ionizes to a single negative charge, at least one of which is a sulfo, carboxy, or hydroxy group, provided the hydroxy group is substantially ionized in the range of pH 10 to 11. Preferably, the benzene compound has one, and only one, such solubilizing group, and up to one additional substituent group other than a solubilizing group that is not substantially ionized in the range of pH 10 to 11 (such as an alkyl group having 1 to 4 carbon atoms, a nitro group, a hydroxy group, provided it is not substantially ionized in the range of pH 10 to 11, or an amino group). Particularly useful solubilizing groups are the carboxy and sulfo groups (or salts thereof), and particularly useful additional substituents include methyl, ethyl, nitro, and hydroxy groups. More preferably, the benzene compound is substituted with a single carboxy group (or salt thereof).

The solubilizing groups on the benzene compound can be directly bonded to benzene carbons or attached "indirectly" through an alkylene linking group having 1 to 3 carbon atoms.

Alternatively, the organic co-solvent can be an aliphatic compound comprising an alkyl chain (linear or branched) having 4 to 8 carbon atoms that is substituted with a carboxy, sulfo, or phospho group (or salt thereof). Preferably, the alkyl chain is substituted with one or more carboxy or sulfo groups. The alkyl chain can include one or more other substituents that are not solubilizing groups. Preferably, the alkyl chain (linear or branched) has 5 or 6 carbon atoms and has a single sulfo or carboxy substituent.

Representative organic co-solvents useful in the practice of this invention include the following acids or their salts: benzoic acid, p-toluic acid, phenyl acetic acid, hexanoic acid, 2-pentanesulfonic acid, octanoic acid, salicyclic acid, 1-hexanesulfonic acid, 2-ethylhexanoic acid, capric acid, 4-t-butylbenzoic acid, valeric acid, isovaleric acid, benzenesulfonic acid, butanesulfonic acid, 3-(4-morpholino) propanesulfonic acid, pivalic acid, 2-nitrobenzoic acid, 2-methylbutyric acid, m-aminobenzoic acid, 1-propanesulfonic acid, o-nitrophenol, or an alkali metal or ammonium salt of any of these acids. p-Toluic acid or an alkali metal salt thereof is most preferred.

By "photographically inactive" is meant that the organic co-solvents useful in this invention cause or provide no substantial positive or negative effect upon the color developing function of the concentrate.

Representative co-solvents useful in the practice of this invention are the following compounds CS-1 through CS-18:

CS-1

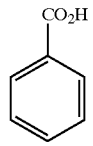

CS-2

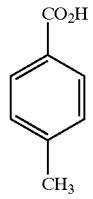

CS-3

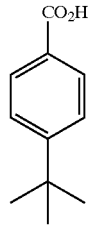

CS-4

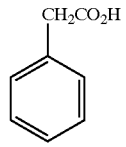

CS-5

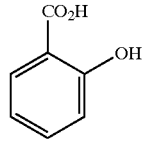

CS-6

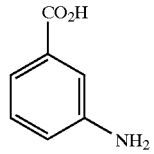

-continued

CS-7

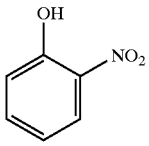

CS-8

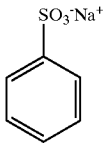

CS-9

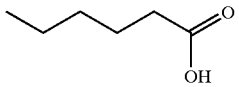

CS-10

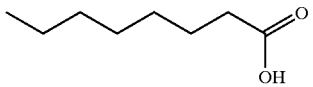

CS-11

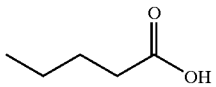

CS-12

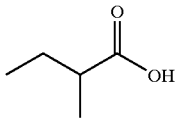

CS-13

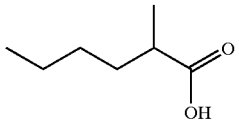

CS-14

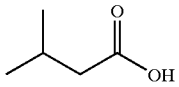

CS-15

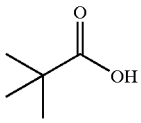

CS-16

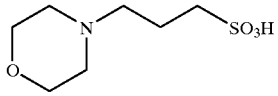

CS-17

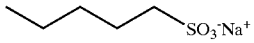

CS-18

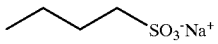

CS-19

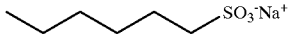

CS-20

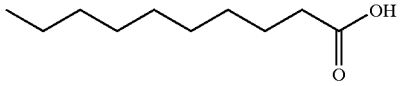

-continued

CS-21

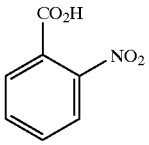

The amounts of water and organic co-solvent in the concentrate are carefully controlled to achieve all of the desired results and to insure a single phase homogeneous concentrate. If there is too much water, phase separation may occur. If there is too much organic co-solvent, the buffering agent and other salts will precipitate. The water to organic co-solvent weight ratio is from about 7:1 to about 30:1 and preferably from about 10:1 to about 15:1. For p-toluic acid and its salts, the most preferred weight ratio of water to organic co-solvent is from about 10:1 to about 12.5:1.

The color developing concentrates of this invention can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The amounts of such additives are well known in the art also. Representative color developing concentrates of this invention are described below in Example 1.

The following TABLE I shows the general and preferred amounts of essential and some optional components of the color developing concentrates of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath.

TABLE I

| COMPONENT | CONCENTRATE CONCENTRATIONS |
|---|---|
| Color developing agent | 0.05–0.25 mol/l<br>(0.1–0.2 mol/l) |
| N,N-dialkylhydroxylamine | _0.1–0.5 mol/l<br>(_0.2–0.4 mol/l) |
| Sulfite ions | 0–0.6 mol/l<br>(0.2–0.4 mol/l) |
| Water to organic co-solvent (weight ratio) | 7:1 to 30:1<br>(10:1 to 15:1) |
| Buffering agent | 1–4 mol/l<br>(2–3 mol/l) |

The color developing concentrates of this invention have utility to provide color development in an imagewise exposed color photographic silver halide element comprising a substantially transparent support and one or more silver halide emulsion layers containing an imagewise distribution of developable silver halide emulsion grains. A wide variety of types of photographic elements (color negative films, color reversal films, and color motion picture films containing various types of emulsions can be processed using the present invention, the types of elements being well known in the art (see *Research Disclosure*, noted above). The color developer concentrate is particularly useful for providing color negative images in color negative photographic silver halide films.

The processed color negative films may have a magnetic recording layer, or stripe, on the support opposite the silver halide emulsion layer(s). Formulations for preparing magnetic recording layers are also well known in the art, as described for example, in Research Disclosure, publication 34390, November, 1992, U.S. Pat. No. 5,395,743 (Brick et al.), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding, or laminating.

Various supports can be used for such color films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane4,4'-dicarboxylate and poly (butylene terephthalate) are preferred. These materials can be subbed or unsubbed and coated with various antihalation, antistatic, or other non-imaging layers as is known in the art. Particularly useful antistatic layers on the backside of the materials include vanadium pentoxide in a suitable binder.

Representative photographic color negative films that can be processed to advantage using the present invention include, but are not limited to, KODAK ROYAL GOLD® Color Films (especially the 1000 speed color film), KODAK GOLD MAX® Color Films, KODAK ADVANTIX® Color Films, KODAK VERICOLOR® III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

Some specific commercially available color reversal photographic films that can be processed using this invention include EKTACHROME® Color Reversal Films (Eastman Kodak Company), FUJICHROME Color Reversal Films (Fuji Photo Film Co., Ltd.), AGFACHROME Color Reversal Films (AGFA), and KONICACHROME Color Reversal Films (Konica).

The photographic color films processed in the practice of this invention can be single or multilayer color films. Multilayer color negative films typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole type magenta dye forming couplers).

Color development of an imagewise exposed color negative or reversal photographic silver halide film is carried out by contacting the film with a color developing composition prepared according to this invention under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films (see for example, *Research Disclosure*, noted above).

Color reversal films usually require additional processing steps as required in the conventional Process E-6 processing method. The conditions and solutions generally used for processing color reversal films are well known. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, stabilizing can occur between color developing and bleaching. Many details of such processes are provided in U.S. Pat. No. 5,552,264 (Cullinan et al.), incorporated herein by reference.

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al.) and publications noted therein.

Color development is generally followed with one or more desilvering steps including one or more bleaching and fixing steps, or bleach/fixing step, using suitable silver bleaching and fixing agents.

Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP 0 532,003A1, and ethylenediamine monosuccinic acid and similar compounds as described in U.S. Pat. No. 5,691,120 (Wilson et al.).

The processing time and temperature used for each processing step of the present invention are generally those conventionally used in the art (such as for the conventional Process C-41, Process E-6 and Process K-14). For example, color development is generally carried out at a temperature of from about 20 to about 60° C. (preferably from about 35 to about 55° C.). The overall color development time can be up to 40 minutes, preferably from about 75 to about 450 seconds, and more preferably for less than 195 seconds.

The color developing concentrate of this invention can be formulated into a working strength solution or replenisher by suitable dilution of up to 12 times. Generally, the dilution rate is from about 4 to about 10 times, using water as a common diluent. Dilution can occur during or prior to processing.

In one embodiment of this invention, the color developing concentrate is one chemical formulation in a photographic processing chemical kit that can include one or more other photographic processing compositions (dry or liquid) including, but not limited to, a photographic bleaching composition, a photographic bleach/fixing composition, a photographic fixing composition, and a photographic stabilizing or rinsing composition. Such additional compositions can be formulated in concentrated or working strength solutions, or provided in dry form (for example, as a powder or tablet). The processing kits can also include various processing equipment, metering devices, processing instructions, silver recovery devices and other conventional materials as would be readily apparent to one skilled in the art.

The following examples are provided to illustrate the practice of this invention and not to limit it in any way. Unless otherwise indicated, percentages are by weight.

Comparative co-solvents used in the examples are the following compounds Comp-1 through Comp-10:

Comp-1

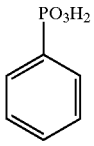

Comp-2

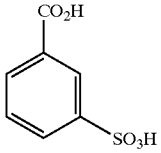

Comp-3

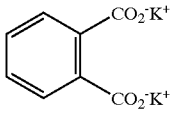

Comp-4

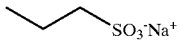

Comp-5

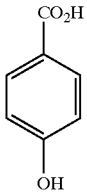

Comp-6

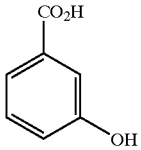

-continued

Comp-7

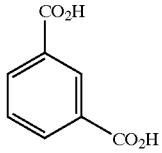

Comp-8

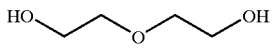

Comp-9

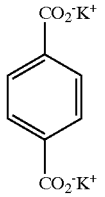

Comp-10

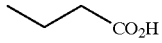

The organic antioxidants used in the following examples were the following compounds:

AO-1

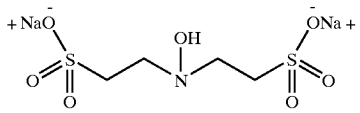

AO-2

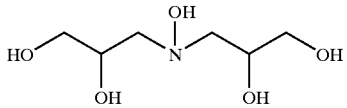

EXAMPLE 1

Color Developing Agent Solubility in Concentrates Using Various Co-solvents

The co-solvent shown in TABLE I below were tested for their ability to solubilize KODAK Color Developing Agent CD-4 in free base form, in a solution matrix similar to conventional color developing concentrates. KODAK Color Developing Agent CD-4 was prepared in free base form by neutralizing a saturated solution of KODAK Color Developing Agent CD-4 disulfate salt with a stoichiometric quantity of 45% potassium hydroxide. The resulting mixture was stirred and allowed to separate into two layers, the KODAK Color Developing Agent CD-4 free base oil being in the top layer. The top layer was then drawn off for use in the solubility test.

A solution was prepared containing approximately 90 g/l solution of the various co-solvents using a stock solution containing 233 g/l of potassium carbonate, 84.5 g/l of potassium bicarbonate and 67 g/l of potassium sulfite at pH 10.4. Free acid co-solvents were neutralized with a stoichiometric quantity of 45% potassium hydroxide before the test solution was prepared. KODAK Color Developing Agent CD-4 in free base was then added to each test solution with stirring, and the quantity was monitored by weight until precipitation occurred. Using the final volume of the saturated solution and the amount of color developing agent added, the solubility of the color developing agent was calculated. The following TABLE I shows the compounds ranked in order of decreasing KODAK Color Developing Agent CD-4 solubility.

TABLE 1

| Co-solvent | | Charge at pH 10–11 | No. of C atoms in Y group | g/l of Co-solvent | Solubility of KODAK Color Developing Agent CD-4 (g/l) | Invention or Comparison |
|---|---|---|---|---|---|---|
| Hexanoic Acid | CS-9 | −1 | 5 | 75 | 95 | Invention |
| p-Toluic acid | CS-2 | −1 | 7 | 74 | 89 | Invention |
| Phenyl Acetic Acid | CS-4 | −1 | 7 | 77 | 86 | Invention |
| Benzoic Acid | CS-1 | −1 | 6 | 85 | 73 | Invention |
| Octanoic Acid | CS-10 | −1 | 7 | 77 | 64 | Invention |
| Salicylic acid | CS-5 | −1 | 6 | 78 | 62 | Invention |
| Sodium 1-pentanesulfonate | CS-17 | −1 | 5 | 85 | 60 | Invention |
| o-Nitrophenol | CS-7 | −1 | 6 | 81 | 59 | Invention |
| Valeric Acid | CS-11 | −1 | 4 | 76 | 54 | Invention |
| 2-Ethylhexanoic acid | CS-13 | −1 | 7 | 79 | 53 | Invention |
| Isovaleric acid | CS-14 | −1 | 4 | 86 | 49 | Invention |
| Sodium 1-Hexanesulfonate | CS-19 | −1 | 6 | 86 | 47 | Invention |
| Capric Acid | CS-20 | −1 | 9 | 81 | 44 | Invention |
| 4-t-Butylbenzoic acid | CS-3 | −1 | 10 | 80 | 42 | Invention |
| Pivalic acid | CS-15 | −1 | 4 | 80 | 32 | Invention |
| Sodium 1-butanesulfonate | CS-18 | −1 | 4 | 86 | 29 | Invention |
| 2-Methylbutyric acid | CS-12 | −1 | 4 | 80 | 28 | Invention |
| Sodium Benzeneulfonate | CS-8 | −1 | 6 | 90 | 28 | Invention |
| 2-Nitrobenzoic acid | CS-21 | −1 | 6 | 83 | 20 | Invention |
| 3-(4-Morpholino)-propanesulfonic acid | CS-16 | −1 | 7 | 82 | 18 | Invention |
| m-Aminobenzoic acid | CS-6 | −1 | 6 | 83 | 9 | Invention |
| Benzenephosphonic acid | Comp-1 | −2 | 6 | 81 | 4 | Comparison |
| m-Sulfobenzoic acid* 1 $Na^+$ Salt | Comp-2 | −2 | 6 | 86 | 4 | Comparison |
| Potassium phthalate | Comp-3 | −2 | 6 | 86 | 4 | Comparison |
| Sodium 1-propanesulfonate | Comp-4 | −1 | 3 | 88 | 4 | Comparison |
| p-Hydroxybenzoic acid | Comp-5 | −2 | 6 | 83 | 4 | Comparison |
| m-Hydroxybenzoic acid | Comp-6 | −2 | 6 | 81 | 4 | Comparison |
| Isophthalic acid | Comp-7 | −2 | 6 | 79 | 4 | Comparison |
| Diethylene glycol | Comp-8 | N.A. | N.A. | 90 | 4 | Comparison |
| Disodium Terephthalate | Comp-9 | −2 | 6 | 90 | <4 | Comparison |
| Butyric Acid | Comp-10 | −1 | 3 | 90 | <4 | Comparison |

"N.A." = not available

EXAMPLE 2

Solubility of Various Color Developing Agents Using Sodium Benzoate as Co-solvent The solubility of KODAK Color Developing Agents CD-2 and CD-3 were tested in the same manner described in Example 1 for KODAK Color Developing Agent CD-4. The results are shown in TABLE II below.

TABLE II

| Color Developer Agent | Co-Solvent | Amount of Co-Solvent (g/l) | Color Developing Agent Solubility |
|---|---|---|---|
| CD-2[a] | Sodium Benzoate | 88 | 12 |
| CD-3[b] | Sodium Benzoate | 85 | 66 |

TABLE II-continued

| Color Developer Agent | Co-Solvent | Amount of Co-Solvent (g/l) | Color Developing Agent Solubility |
|---|---|---|---|
| CD-2[a] | Diethylene glycol | 90 | <4 |
| CD-3[b] | Diethylene glycol | 90 | <4 |

[a]CD-2 free base form: Prepared by treating a saturated solution of KODAK Color Developing Agent CD-2 hydrochloride with a stoichiometric quantity of 45% potassium hydroxide. The color developing agent free base oil separated into a top layer that was removed for use.

[b]CD3 free base form: Prepared by treating a saturated solution of KODAK Color Developing Agent CD-3 sesquisulfate monohydrate with a stoichiometric quantity of 45% potassium hydroxide. The resulting mixture was stirred and the color developing agent free base form was allowed to separate into a top layer that was removed for use.

EXAMPLE 3

Color Negative Film Color Developing Concentrate

A color developing concentrate of this invention and a comparison (Control) concentrate were formulated by mixing the components shown in TABLE III below. These concentrates were formulated to deliver a working strength color developing agent upon a seven-fold dilution with water. A 45% potassium hydroxide solution was used to neutralize the color developing agent (a sulfate salt) and the p-toluic acid. Before the final dilution with water, the solutions were filtered to remove the potassium sulfate that precipitated as a result of the color developing agent neutralization. This filtration was performed when the volume of the concentrate was at approximately 70% of its final volume. In the case of the Control, the color developing agent did not significantly dissolve. For the Invention concentrate, a homogeneous solution was obtained and no solids precipitated from the solution after storing the concentrate for 2 weeks at 0° F. (−17.7° C.). Chemical analysis of the two concentrates confirmed that all the color developing agent added remained in solution even after storage.

| Component | g/l Control | g/l Invention |
|---|---|---|
| Potassium bromide | 2.9 | 2.9 |
| Diethylenetriaminepentacetic acid pentasodium salt (40% w/w solution) | 55 | 55 |
| Potassium carbonate | 236 | 236 |
| Potassium sulfate | 47 | 47 |
| p-Toluic acid | 0 | 57 |
| Antioxidant AO-1 | 29 | 29 |
| KODAK Color Developing Agent CD-4 | 42 | 42 |
| Solution pH | 10.76 | 10.76 |
| Results | Color developing agent did not dissolve during concentrate preparation | Homogeneous concentrate. No precipitation after cold storage |

EXAMPLE 4

Sensitometric Effect of Co-Solvents in the Presence of N,N-dialkylhydroxylarine Antioxidants Twelve commercially available color negative photographic silver halide films were given a 21-step sensitometric exposure and processed in three different processes: (1) standard C-41 process, (2) a standard C-41 process in which the color developing composition contained 35–37 g/l of the co-solvent diethylene glycol with hydroxylamine sulfate as the antioxidant (3) a process in which the color developing composition of the present invention contain a co-solvent and organic antioxidant. The Invention compositions (Process 3) resulted from a seven-fold dilution of the Inventive concentrates similar to that described in Example 3. The working strength compositions were formulated as shown in the following TABLE IV.

TABLE IV

| Component | g/l for Process 1 (Comparison) | g/l for Process 2 (Comparison) | g/l for Process 3 (Invention) |
|---|---|---|---|
| Potassium Carbonate | 50.80 | 50.80 | 50.80 |
| Sodium Sulfite | 3.75 | 3.75 | 3.75 |
| Potassium Iodide | 0.0012 | 0.0012 | 0.0012 |
| Sodium Bromide | 1.30 | 1.30 | 1.30 |

TABLE IV-continued

| Component | g/l for Process 1 (Comparison) | g/l for Process 2 (Comparison) | g/l for Process 3 (Invention) |
|---|---|---|---|
| Antioxidant | 2.0 g/l hydroxylamine sulfate | 2.0 g/l hydroxylamine sulfate | See TABLE V |
| Diethylenetriamine-pentacetic acid pentasodium salt (40% w/w solution) | 2.6 | 2.6 | 2.6 |
| KODAK Color Developing Agent CD-4 | 4.5 | 4.5 | 4.5 |
| Co-solvent | none | Diethylene glycol (see TABLE V) | Invention co-solvent (see TABLE V) |
| pH (adjusted with $H_2SO_4$) | 10.05 | 10.05 | 10.05 |

The complete process, including use of the color developing compositions described above, followed the conventional Process C-41 protocol and conditions to obtain acceptable color images:

| | | |
|---|---|---|
| Color Development | 37.8° C. | 195 seconds |
| Bleaching | 37.8° C. | 240 seconds |
| Wash | 36° C. | 180 seconds |
| Fixing | 37.8° C. | 240 seconds |
| Wash | 36° C. | 180 seconds |
| Stabilizing | 37.8° C. | 60 seconds |

Bleaching, fixing, and stabilizing were carried out using commercially available KODAK FLEXICOLOR chemical processing solutions appropriate for each processing step.

The red, green and blue optical densities at each exposure step were measured for each color negative film for each of the above three noted processes. For each film, at each exposure step and for each color record, the density obtained using process (1) was subtracted from the density obtained using either process (2) or process (3). The absolute value of the resulting difference was summed over all 21 steps and all three color records (R=red, G=green, B=blue) for each film. The sensitometric data in the following TABLE V demonstrate the photographic advantages of the invention co-solvents (Process 3) over the use of diethylene glycol (Process 2).

TABLE V

| Color Negative Film | Co-Solvent | Antioxidant | Sum of Absolute Value of R,G,B Density Deviations (over 21 steps) | Invention or Comparison |
|---|---|---|---|---|
| KONICA CENTURIA 400 | 35 g/l DEG | 2.0 g/l HAS | 2.716 | Comparison |
| KONICA CENTURIA 400 | 9.0 g/l Sodium Benzoate | 7.0 g/l AO-1 | 1.115 | Invention |
| KONICA CENTURIA 200 | 35 g/l DEG | 2.0 g/l HAS | 2.367 | Comparison |
| KONICA CENTURIA 200 | 9.0 g/l Sodium Benzoate | 7.0 g/l AO-1 | 1.283 | Invention |
| KODAK MAX ® ZOOM 800 | 35 g/l DEG | 2.0 g/l HAS | 2.862 | Comparison |
| KODAK MAX ® ZOOM 800 | 9.0 g/l Sodium Benzoate | 8.42 g/l AO-2 | 0.749 | Invention |
| KODAK MAX ® ZOOM 800 | 9.0 g/l Sodium Benzoate | 7.1 g/l AO-1 | 1.445 | Invention |
| KODAK MAX ® 400 | 35 g/l DEG | 2.0 g/l HAS | 2.285 | Comparison |
| KODAK MAX ® 400 | 9.0 g/l Sodium Benzoate | 8.42 g/l AO-2 | 1.45 | Invention |
| KODAK MAX ® 400 | 9.0 g/l Sodium Benzoate | 7.1 g/l AO-1 | 0.997 | Invention |
| KODAK MAX ® 400 | 9.0 g/l p-Toluic Acid | 4.0 g/l AO-1 | 1.854 | Invention |
| KODAK GOLD ® 200 | 37 g/l DEG | 2.0 g/l HAS | 2.306 | Comparison |
| KODAK GOLD ® 200 | 9.0 g/l Sodium Benzoate | 7.1 g/l AO-1 | 1.157 | Invention |
| KODAK Advantix ® 400 | 35 g/l DEG | 2.0 g/l HAS | 2.495 | Comparison |
| KODAK Advantix ® 400 | 9.0 g/l Sodium Benzoate | 8.42 g/l AO-2 | 1.281 | Invention |
| KODAK Advantix ® 400 | 9.0 g/l Sodium Benzoate | 7.1 g/l AO-1 | 0.952 | Invention |
| KODAK Advantix ® 200 | 35 g/l DEG | 2.0 g/l HAS | 2.374 | Comparison |
| KODAK Advantix ® 200 | 9.0 g/l Sodium Benzoate | 7.1 g/l AO-1 | 1.18 | Invention |
| KODAK Advantix ® 200 | 9.0 g/l p-Toluic Acid | 4.0 g/l AO-1 | 1.615 | Invention |
| FUJI SUPERIA 400 | 35 g/l DEG | 2.0 g/l HAS | 3.507 | Comparison |
| FUJI SUPERIA 400 | 9.0 g/l Sodium Benzoate | 7.0 g/l AO-1 | 1.554 | Invention |
| FUJI SUPERIA 200 | 35 g/l DEG | 2.0 g/l HAS | 2.484 | Comparison |
| FUJI SUPERIA 200 | 9.0 g/l p-Toluic Acid | 4.0 g/l AO-1 | 2.289 | Invention |
| FERRANIA SOLARIS 400 | 35 g/l DEG | 2.0 g/l HAS | 3.865 | Comparison |
| FERRANIA SOLARIS 400 | 9.0 g/l Sodium Benzoate | 7.0 g/l AO-1 | 1.362 | Invention |
| AGFA HDC PLUS 400 | 35 g/l DEG | 2.0 g/l HAS | 3.689 | Comparison |
| AGFA HDC PLUS 400 | 9.0 g/l Sodium Benzoate | 7.0 g/l AO-1 | 2.476 | Invention |
| AGFA HDC PLUS 400 | 9.0 g/l p-Toluic Acid | 4.0 g/l AO-1 | 1.351 | Invention |
| AGFA HDC PLUS 200 | 35 g/l DEG | 2.0 g/l HAS | 3.959 | Comparison |
| AGFA HDC PLUS 200 | 9.0 g/l p-Toluic Acid | 4.0 g/l AO-1 | 1.901 | Invention |

EXAMPLE 5

Color Reversal Film Color Developing Concentrate

A single part color developing concentrate of this invention, suitable for a color reversal color developer was formulated by mixing the components shown in the following TABLE VI. These concentrates were formulated to deliver a working strength developer upon a seven-fold dilution with water. A 45% potassium hydroxide solution was used to neutralize the developing agent (a sulfate salt) and the p-toluic acid co-solvent. Before the final dilution with water, the solutions were filtered to remove the potassium sulfate that precipitated as a result of the developing agent neutralization. This filtration was performed when the volume of the concentrate was at approximately 70% of its final volume. In the case of the comparison concentrate (Control), the color developing agent did not significantly dissolve. For the Invention concentrate, a homogeneous solution was obtained.

TABLE VI

| Component | g/L(Control) | g/L (Invention) |
|---|---|---|
| Aminotris(methylenephosphonic acid), penta-sodium salt | 47 | 47 |
| Phosphoric acid(75%) | 122 | 122 |
| Sodium Bromide | 4.6 | 4.6 |
| Sodium Sulfite | 47 | 47 |
| Citrazinic acid | 4 | 4 |
| p-Toluic acid | 0 | 90 |
| KODAK Color Developing Agent CD-3 | 73 | 73 |
| 2,2'-(Ethylenedithio)diethanol | 6.1 | 6.1 |
| pH | 12.00 | 12.00 |

The invention has been described in detail with particular reference to certain preferred embodiments thereof, but it will be understood that variations and modifications can be effected within the spirit and scope of the invention.

We claim:

1. An aqueous, homogeneous, single-part color developing concentrate having a pH of from about 9 to about 13 and comprising:

a) at least 0.05 mol/l of an N,N-dialkyl-p-phenylenediamine color developing agent in free base form, b) at least 0.1 mol/l of an antioxidant composition for said color developing agent that comprises an N,N-dialkyl- or N,N-diarylhydroxylamine derivative having at least one solubilizing group, and c) a water-miscible or water-soluble organic co-solvent that has a molecular weight of from about 100 to about 400, is present in said concentrate at a concentration such that the weight ratio of water to said organic co-solvent is from about 7:1 to about 30:1, and is represented by the following Structure I:

$Y—Z^-M^+$ (I)

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, $Z^-$ is a monovalent group comprising a single negative charge or an acidic group that is ionized to a single negative charged group at pH of 10 or more, and $M^+$ is a monovalent cation.

2. The color developing concentrate of claim 1 wherein said organic co-solvent is either a benzene ring having one carboxy or sulfo substituent or an aliphatic compound comprising a 4- to 8-carbon atom alkyl chain that has one carboxy or sulfo substituent.

3. The color developing concentrate of claim 1 having a pH of from about 10 about 11.

4. The color developing concentrate of claim 1 wherein said color developing agent is present in an amount of from about 0.1 to about 0.2 mol/l, said N,N-dialkyl- or N,N-diarylhydroxylamine derivative is present in an amount of from about 0.2 to about 0.4 mol/l, and the weight ratio of water to said organic co-solvent is from about 10:1 to about 15:1.

5. The color developing concentrate of claim 1 wherein said antioxidant is a hydroxylamine derivative having two alkyl groups each having 1 to 4 carbon atoms and at least one of said alkyl groups having a sulfo, carboxy, or hydroxy group.

6. The color developing concentrate of claim 5 wherein said N,N-dialkylhydroxylamine has the same alkyl groups having 2 or 3 carbon atoms, at least one of which has a sulfo or hydroxy group.

7. The color developing concentrate of claim 1 wherein said N,N-dialkylhydroxylamine is N,N-bis(ethylenesulfonato)hydroxylamine, N-isopropyl-N-ethylsulfonatohydroxylamine, or N,N-bis(2,3-dihydroxypropyl)hydroxylamine.

8. The color developing concentrate of claim 1 wherein said antioxidant composition consists essentially of said N,N-dialkylhydroxylamine derivative.

9. The color developing concentrate of claim 1 further comprising at least 0.1 mol/l of sulfite ions.

10. The color developing concentrate of claim 1 wherein said organic co-solvent is an aliphatic compound having a molecular weight of from about 120 to about 220, and comprising an alkyl chain having 4 to 8 carbon atoms that is substituted with a carboxy or sulfo group.

11. The color developing concentrate of claim 1 wherein said organic co-solvent is a benzene compound substituted with one carboxy group.

12. The color developing concentrate of claim 1 wherein said organic co-solvent is benzoic acid, p-toluic acid, phenyl acetic acid, hexanoic acid, 2-pentanesulfonic acid, octanoic acid, salicyclic acid, 1-hexanesulfonic acid, 2-ethylhexanoic acid, capric acid, 4-t-butylbenzoic acid, valeric acid, isovaleric acid, benzenesulfonic acid, butanesulfonic acid, 3-(4-morpholino)propanesulfonic acid, pivalic acid, 2-nitrobenzoic acid, 2-methylbutyric acid, m-aminobenzoic acid, 1-propanesulfonic acid, o-nitrophenol, or an alkali metal or ammonium salt of any of these acids.

13. The color developing concentrate of claim 1 wherein said organic co-solvent is p-toluic acid or an alkali metal salt thereof.

14. The color developing concentrate of claim 1 further comprising a buffering agent that is soluble in said organic co-solvent.

15. An aqueous, homogeneous, single-part color developing concentrate having a pH of from about 10 to about 11 and comprising:

a) from about 0.05 to about 0.2 mol/l of 4-(N,N-diethyl)-2-methylaniline hydrochloride (KODAK Color Developing Agent CD-2), 4-(N-ethyl-N-methanesulfonamidoethyl)-2-methylaniline sesquisulfate (KODAK Color Developing Agent CD-3), or 4-(N-ethyl-N-β-hydroxyethyl)-2-methylaniline sulfate (KODAK Color Developing Agent CD-4), each in free base form, b) from about 0.1 to about 0.4 mol/l of an antioxidant composition for said color developing agent that consists essentially of N,N-bis(ethylenesulfonato) hydroxylamine, N,N-bis(2,3-dihydroxypropyl) hydroxylamine, or N-isopropyl-N-ethylsulfonatohydroxylamine, c) a water-miscible or water-soluble benzoic acid or an alkali metal salt thereof that has a molecular weight of from about 120 to about 220, is present in said concentrate at a concentration such that the weight ratio of water to said organic co-solvent is from about 7:1 to about 30:1, e) a carbonate buffering agent, and f) from about 0.1 to about 0.50 mol/l of sulfite ions.

16. A photographic processing chemical kit comprising:

I) an aqueous, homogeneous, single-part color developing concentrate having a pH of from about 9 to about 13 and comprising:

a) at least 0.05 mol/l of an N,N-dialkyl-p-phenylenediamine color developing agent in free base form, b) at least 0.1 mol/l of an antioxidant composition for said color developing agent that comprises an N,N-dialkyl- or N,N-diarylhydroxylamine derivative having at least one solubilizing group, and c) a water-miscible or water-soluble organic co-solvent that has a molecular weight of from about 100 to about 400, is present in said concentrate at a concentration such that the weight ratio of water to said organic co-solvent is from about 7:1 to about 30:1, and is represented by the following Structure I:

$Y—Z^-M^+$ (I)

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, or a carbocyclic aryl group having 6 or 10 carbon atoms in the ring, $Z^-$ is a monovalent group comprising a single negative charge or an acidic group that is ionized to a single negative charged group at pH of 10 or more, and $M^+$ is a monovalent cation, and II) one or more of the following compositions:

a photographic bleaching composition, a photographic bleach/fixing composition, a photographic fixing composition, or a photographic stabilizing or final rinsing composition.

17. A method for providing a color photographic image comprising contacting a color negative or color reversal photographic silver halide film with, upon dilution at least 2.5 times, an aqueous, homogeneous, single-part color developing concentrate having a pH of from about 9 to about 13 and comprising:

a) at least 0.05 mol/l of an N,N-dialkyl-p-phenylenediamine color developing agent in free base form, b) at least 0.1 mol/l of an antioxidant composition for said color developing agent that comprises an N,N-dialkyl- or N,N-diarylhydroxylamine derivative having at least one solubilizing group, and c) a water-miscible or water-soluble organic co-solvent that has a molecular weight of from about 100 to about 400, is present in said concentrate at a concentration such that the weight ratio of water to said organic co-solvent is from about 7:1 to about 30:1, and is represented by the following Structure I:

$$Y—Z^{-}M^{+} \quad (I)$$

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, or a carbocyclic aryl group having 6 or 10 carbon atoms in the ring, $Z^{-}$ is a monovalent group comprising a single negative charge or an acidic group that is ionized to a single negative charged group at pH of 10 or more, and $M^{+}$ is a monovalent cation.

18. A method of photographic processing comprising the steps of:

A) color developing an imagewise exposed color negative or color reversal photographic silver halide film with, upon dilution at least four times, an aqueous, homogeneous, single-part color developing concentrate having a pH of from about 9 to about 13 and comprising:

a) at least 0.05 mol/l of an N,N-dialkyl-p-phenylenediamine color developing agent in free base form, b) at least 0.1 mol/l of an antioxidant composition for said color developing agent that comprises an N,N-dialkyl- or N,N-diarylhydroxylamine derivative having at least one solubilizing group, and c) a water-miscible or water-soluble organic co-solvent that has a molecular weight of from about 100 to about 400, is present in said concentrate at a concentration such that the weight ratio of water to said organic co-solvent is from about 7:1 to about 30:1, and is represented by the following Structure I:

$$Y—Z^{-}M^{+} \quad (I)$$

wherein Y is uncharged in the pH range of from 10 to 11 and is an alkyl group having 4 to 16 carbon atoms, a cycloalkyl group having 5 to 10 carbon atoms in the ring, an alkylene group having 1 to 6 carbon atoms that is additionally substituted with a cycloalkyl group, a carbocyclic aryl group or a heterocyclic group containing 1 to 3 hetero atoms, or a carbocyclic aryl group having 6 or 10 carbon atoms in the ring, $Z^{-}$ is a monovalent group comprising a single negative charge or an acidic group that is ionized to a single negative charged group at pH of 10 or more, and $M^{+}$ is a monovalent cation, and B) desilvering said color developed color negative or color reversal photographic silver halide film.

* * * * *